US008320824B2

(12) United States Patent
Banks et al.

(10) Patent No.: US 8,320,824 B2
(45) **Date of Patent: *Nov. 27, 2012**

(54) METHODS AND SYSTEMS TO PROVIDE AUTOMATIC CONFIGURATION OF WIRELESS SPEAKERS

(75) Inventors: Jano Banks, Cupertino, CA (US); David Buuck, Santa Clara, CA (US); Jeff Boone, Sunnyvale, CA (US); Jon Norenberg, Modesto, CA (US); Brad Bozarth, Mountain View, CA (US); Eric Wiles, Sunnyvale, CA (US); David Northway, San Carlos, CA (US)

(73) Assignee: AliphCom, Inc., San Francisco, CA (US)

( * ) Notice: Subject to any disclaimer, the term of this patent is extended or adjusted under 35 U.S.C. 154(b) by 1106 days.

This patent is subject to a terminal disclaimer.

(21) Appl. No.: 11/860,004

(22) Filed: Sep. 24, 2007

(65) Prior Publication Data

US 2009/0081948 A1 Mar. 26, 2009

(51) Int. Cl.
*H04H 40/00* (2008.01)

(52) U.S. Cl. .. 455/3.06; 455/3.05; 455/132; 340/538.15

(58) Field of Classification Search ..... 455/130, 455/132, 137, 144, 151.2, 153.2, 402, 3.05, 455/3.06; 340/310.11, 538, 288, 538.11–538.15; 381/7, 28, 89

See application file for complete search history.

(56) References Cited

U.S. PATENT DOCUMENTS

| | | | | |
|---|---|---|---|---|
| 6,466,832 | B1 * | 10/2002 | Zuqert et al. | 700/94 |
| 7,194,520 | B1 | 3/2007 | Beard et al. | |
| 7,701,858 | B2 | 4/2010 | Werb et al. | |
| 2003/0231655 | A1 | 12/2003 | Kelton et al. | |
| 2004/0071294 | A1 * | 4/2004 | Halgas et al. | 381/59 |
| 2004/0205438 | A1 | 10/2004 | Chien et al. | |
| 2005/0242948 | A1 * | 11/2005 | Tarr | 340/539.22 |
| 2006/0128442 | A1 * | 6/2006 | Cho | 455/569.1 |
| 2006/0132715 | A1 * | 6/2006 | Ho et al. | 353/15 |
| 2006/0236354 | A1 * | 10/2006 | Sutardja | 725/100 |

(Continued)

FOREIGN PATENT DOCUMENTS

EP 1 457 965 A2 9/2004

(Continued)

OTHER PUBLICATIONS

R.C. Johnson, "UWB boots HD audio standard", XP002539784, EE Times http://ww.eetime.com/Article.jhml?article ID=205207187, 2 pages, Jan. 2, 2008.

*Primary Examiner* — Dominic E Rego

(74) *Attorney, Agent, or Firm* — Kokka & Backus, PC

(57) ABSTRACT

An apparatus is described that includes an AV receiver with a wireless audio module (WAM) host. The apparatus further includes a plurality of wireless speakers each having a WAM device to enable bi-directional communications with the WAM host. The apparatus further includes a wireless input/output device or a plurality of wireless input/output devices embedded in speakers to enable bidirectional communications with the WAM host in order to automatically configure the plurality of wireless speakers to optimize audio parameters of the wireless speakers. The automatic configuration includes determining a location for each speaker in order to identify each speaker. The automatic configuration further includes setting time delay parameters for each speaker. The automatic configuration further includes setting volume parameters for each speaker.

17 Claims, 10 Drawing Sheets

U.S. PATENT DOCUMENTS

| | | | | |
|---|---|---|---|---|
| 2006/0245608 | A1* | 11/2006 | Lee et al. | 381/315 |
| 2008/0040509 | A1 | 2/2008 | Werb et al. | |
| 2008/0084330 | A1 | 4/2008 | Picard | |
| 2008/0168312 | A1 | 7/2008 | Banks et al. | |
| 2008/0242222 | A1* | 10/2008 | Bryce et al. | 455/3.06 |
| 2009/0023397 | A1* | 1/2009 | Andersen | 455/82 |
| 2009/0074112 | A1* | 3/2009 | Coersmeier et al. | 375/340 |
| 2009/0079883 | A1* | 3/2009 | Banks et al. | 348/738 |
| 2009/0081948 | A1* | 3/2009 | Banks et al. | 455/3.05 |
| 2009/0175216 | A1 | 7/2009 | Bozarth et al. | |
| 2009/0204403 | A1* | 8/2009 | Hollander et al. | 704/260 |
| 2009/0238109 | A1 | 9/2009 | Byard et al. | |
| 2010/0185753 | A1 | 7/2010 | Liu et al. | |

FOREIGN PATENT DOCUMENTS

| | | | |
|---|---|---|---|
| WO | WO 01/99384 | A2 | 12/2001 |
| WO | WO 2006/089409 | A1 | 8/2006 |
| WO | WO 2008/085870 | A2 | 7/2008 |

* cited by examiner

METHODS AND SYSTEMS TO PROVIDE AUTOMATIC CONFIGURATION OF WIRELESS SPEAKERS

FIELD

Embodiments of the invention pertain to methods and systems to provide automatic configuration of wireless speakers.

BACKGROUND

In the consumer electronics and computer industries, transmission of audio signals from a host player to remote device speakers has generally been accomplished over an analog wired interface comprising speaker. With the advent of digital audio content, the desire to maintain the pristine digital audio signal as far as possible along the audio signal chain has motivated designers to pursue digital interfaces to replace unsightly, signal-loss-prone analog speaker wires.

The High-Definition Multimedia Interface (HDMI) is an all-digital audio/video interface capable of transmitting uncompressed streams. HDMI is compatible with High-bandwidth Digital Content Protection (HDCP) Digital Rights Management technology. HDMI provides an interface between any compatible digital audio/video source, such as a set-top box, a DVD player, a PC, a video game console, or an audio video (AV) receiver and a compatible digital audio and/or video monitor, such as a digital television (DTV).

FIG. 1 shows an example of a conventional prior art audio video system that includes a source, HDMI AV receiver, with a centralized amplifier connected via an HDMI cable to HDMI DVD player and also connected via an HDMI cable to a display (HDMI TV). The HDMI AV receiver is also connected via analog speaker wires to a set of 6 speakers, each connected point-to-point from the HDMI AV receiver. Speakers in FIG. 1 are identified as follows: Front Left (FL), Front Right (FR), Center (C), Surround Left (SL), Surround Right (SR), and Low Frequency Effect (LFE), also commonly referred to as a "subwoofer."

FIG. 1 contains components which can maintain pristine digital audio and video from source to display through HDMI interconnects. The interconnects from the source to the speakers still comprise analog via conventional speaker wires. For prior art systems containing 6 individual speakers, and other, more advanced systems that support up to 8 speakers or more, the speaker wire interconnections not only suffer from analog signal loss, but the speaker wire interconnections can be an eyesore or be a wire-hiding challenge.

Additionally, configuration and calibration of the speakers in FIG. 1 is performed with a wired analog microphone coupled by a wire to the HDMI AV receiver. Test tones are sent from the AV receiver to a test speaker, which reproduces the test tones. The wired microphone coupled to the AV receiver listens for the test tones reproduced by the test speaker. The AV receiver then calculates delay and volume parameters for the test speaker. The wired microphone is limited in its location and convenience of use by the wire coupled to the AV receiver. The wired microphone also provides analog audio input, rather than pristine digital audio.

SUMMARY

For certain embodiments of the present invention, an apparatus is described that includes an AV receiver with a wireless audio module (WAM) host. The apparatus further includes a plurality of wireless speakers each having a WAM device to enable bidirectional communications with the WAM host. The apparatus further includes a wireless input/output device to enable bidirectional communications with the WAM host in order to automatically configure the plurality of wireless speakers to optimize audio parameters of the wireless speakers. The automatic configuration includes determining a location for each speaker in order to identify each speaker. The automatic configuration further includes setting time delay parameters for each speaker. The automatic configuration further includes setting volume parameters for each speaker.

For some embodiments of the present invention, a method for automatic configuration of a plurality of wireless speakers is described. The method includes sending an audio test tone from a wireless audio module (WAM) host located in an audio receiver to the plurality of wireless speakers. The method further includes sending the audio test tone from each wireless speaker to a wireless input/output device located in an optimum location for configuring audio parameters associated with the plurality of wireless speakers. The method further includes sending audio information from the wireless input/output device to the receiver in order to enable an automatic configuration of the plurality of wireless speakers.

Other features and advantages of embodiments of the present invention will be apparent from the accompanying drawings and from the detailed description that follows below.

BRIEF DESCRIPTION OF THE DRAWINGS

Embodiments of the present invention are illustrated by way of example and not limitation in the figures of the accompanying drawings, in which like references indicate similar elements, and in which.

DETAILED DESCRIPTION

A method for automatic configuration of a plurality of wireless speakers is described. The method includes sending an audio test tone from a WAM host located in a source (e.g., an AV receiver, a DVD player, a display, a integrated DVD player/display, a HDMI AV receiver, a HDMI DVD player, a HDMI display, or an HDMI integrated DVD player/display) to the plurality of wireless speakers. The method further includes sending the audio test tone from each wireless speaker to a wireless input/output device located in an optimum location for configuring audio parameters associated with the plurality of wireless speakers. The method further includes sending audio information from the wireless input/output device to the source in order to enable an automatic configuration of the plurality of wireless speakers.

An intended advantage of providing automatic configuration of wireless speakers is that the wireless input/output device is not coupled to the source. A consumer can easily configure the wireless speakers by locating the wireless input/output device in an ideal listening and configuration position. Another intended advantage is that bidirectional communications between the source and wireless input/output device can optimize the configuration and calibration procedures. Another intended advantage is that the wireless input/output device can be embedded in a remote source controller or in the wireless speakers.

Figure 1:
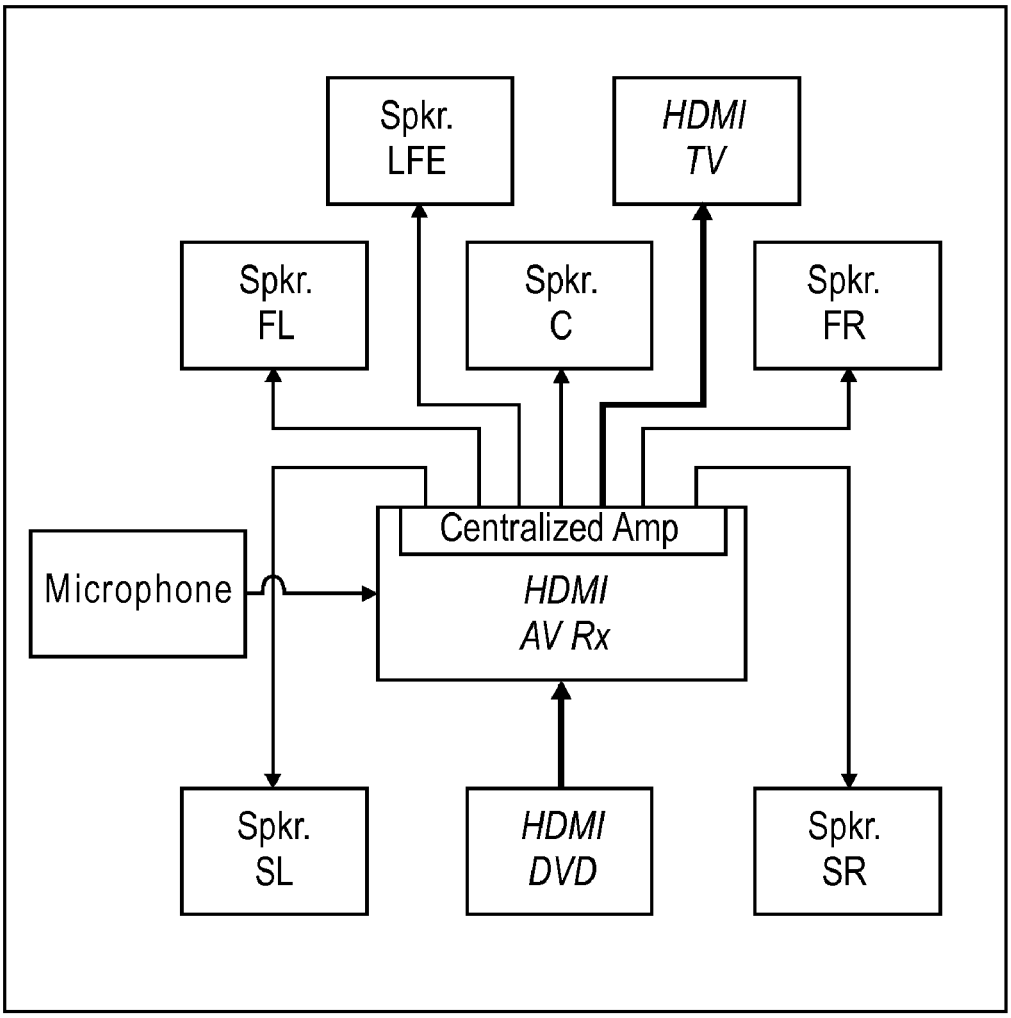
FIG. 1 (PRIOR ART)
FIG. 1 is a block diagram of an example of a prior art AV system having a HDMI AV receiver coupled to analog speaker wires and an analog microphone.
Figure 2:
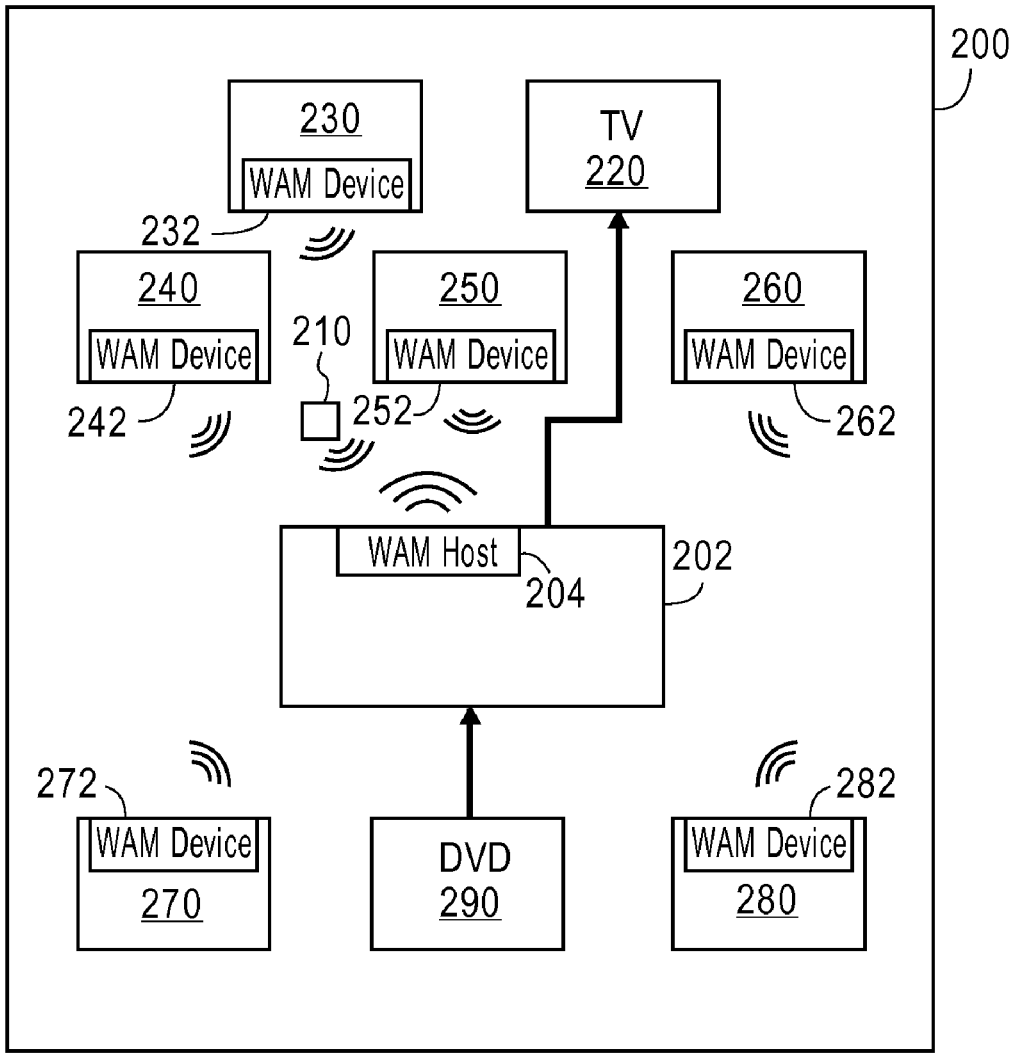
FIG. 2 is a block diagram of an apparatus having an AV receiver with a WAM host in communication with wireless speakers and a wireless input/output device in accordance with an embodiment of the invention.

FIG. 2 is a block diagram of an apparatus having an AV receiver with a WAM host in communication with wireless speakers and a wireless input/output device in accordance with an embodiment of the invention. The apparatus 200 includes the AV receiver 202 with a WAM host 204. The AV receiver 202 is coupled to a TV 220 and a DVD player 290. For certain embodiments, the AV receiver 202 is a HDMI AV receiver which is coupled to a HDMI TV and a HDMI DVD player. For one embodiment, the apparatus 200 further includes a plurality of wireless speakers 230, 240, 250, 260, 270, and 280 each having a respective WAM device 232, 242, 252, 262, 272, and 282 to enable communication with the WAM host 204. For another embodiment, the WAM devices and WAM host communicate control and data information bidirectionally.

The apparatus 200 further includes a wireless input/output device 210 to enable bidirectional communications with the WAM host 204 in order to automatically configure the plurality of wireless speakers 230, 240, 250, 260, 270, and 280 and to optimize audio parameters of the wireless speakers 230, 240, 250, 260, 270, and 280.

The automatic configuration of the wireless speakers includes determining a location for each speaker in order to identify each speaker. The automatic configuration further includes setting time delay parameters for each speaker. The automatic configuration further includes setting volume parameters for each speaker.

For one embodiment, the wireless input/output device 210 is a wireless microphone. For another embodiment, the wireless input/output device 210 is embedded in a remote control device that operates the HDMI receiver. The HDMI receiver can be a separate component or located in a HDMI TV, a HDMI DVD player, or an integrated HDMI TV/DVD player.

The wireless speakers 230, 240, 250, 260, 270, and 280 may represent a front left speaker 240, a front right speaker 260, a center speaker 250, a surround left speaker 270, a surround right speaker 280, and a subwoofer speaker 230. Additional types and kinds of wireless speakers may be added to the apparatus 200 in accordance with certain embodiments.

For some embodiments, the apparatus 200 will adjust various audio parameters to optimize playback based on room acoustics for a given location of the apparatus 200. Communication between the wireless input/output device 210 and the HDMI AV receiver is handled wirelessly to simplify the operation for the end user or consumer. The wireless input/output device 210 can be easily located in an ideal listening position for configuration of the wireless speakers. A consumer can easily configure audio equipment to optimize audio quality in order to match room acoustics.

Figure 3:
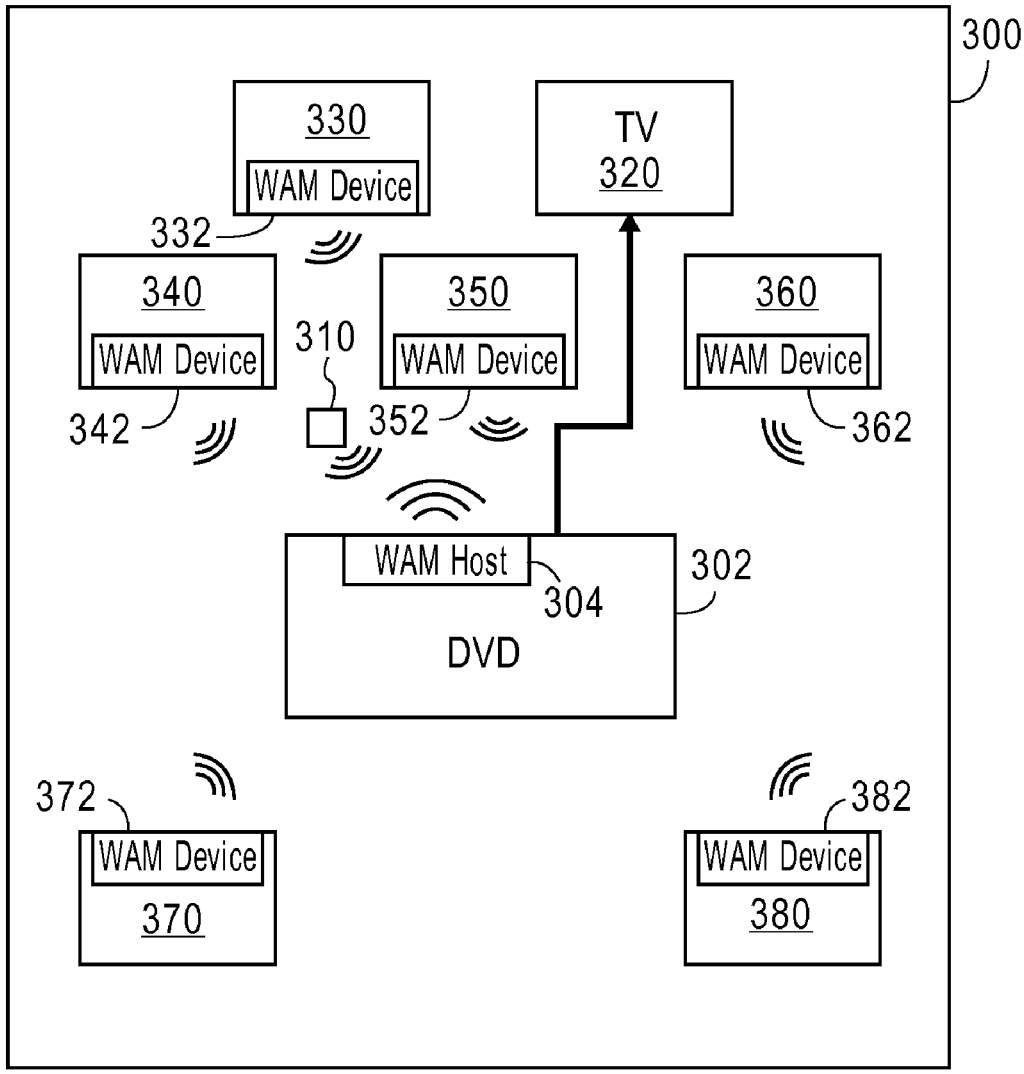
FIG. 3 is a block diagram of an AV system having a DVD player with a WAM host in communication with wireless speakers and a wireless input/output device in accordance with an embodiment of the invention.
Figure 4:
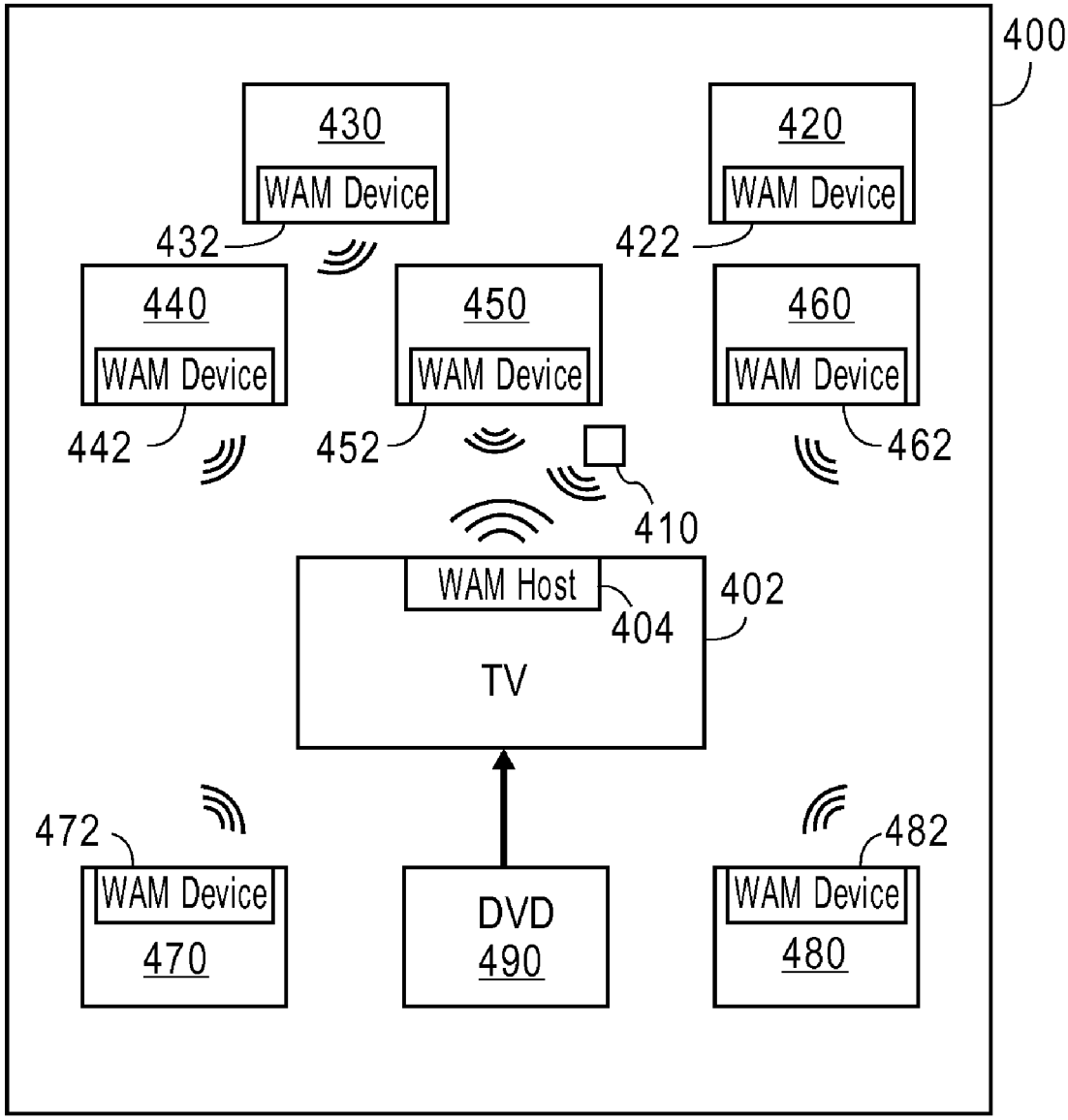
FIG. 4 is a block diagram of an AV system having a display with a WAM host in communication with wireless speakers and a wireless input/output device in accordance with an embodiment of the invention.
Figure 5:
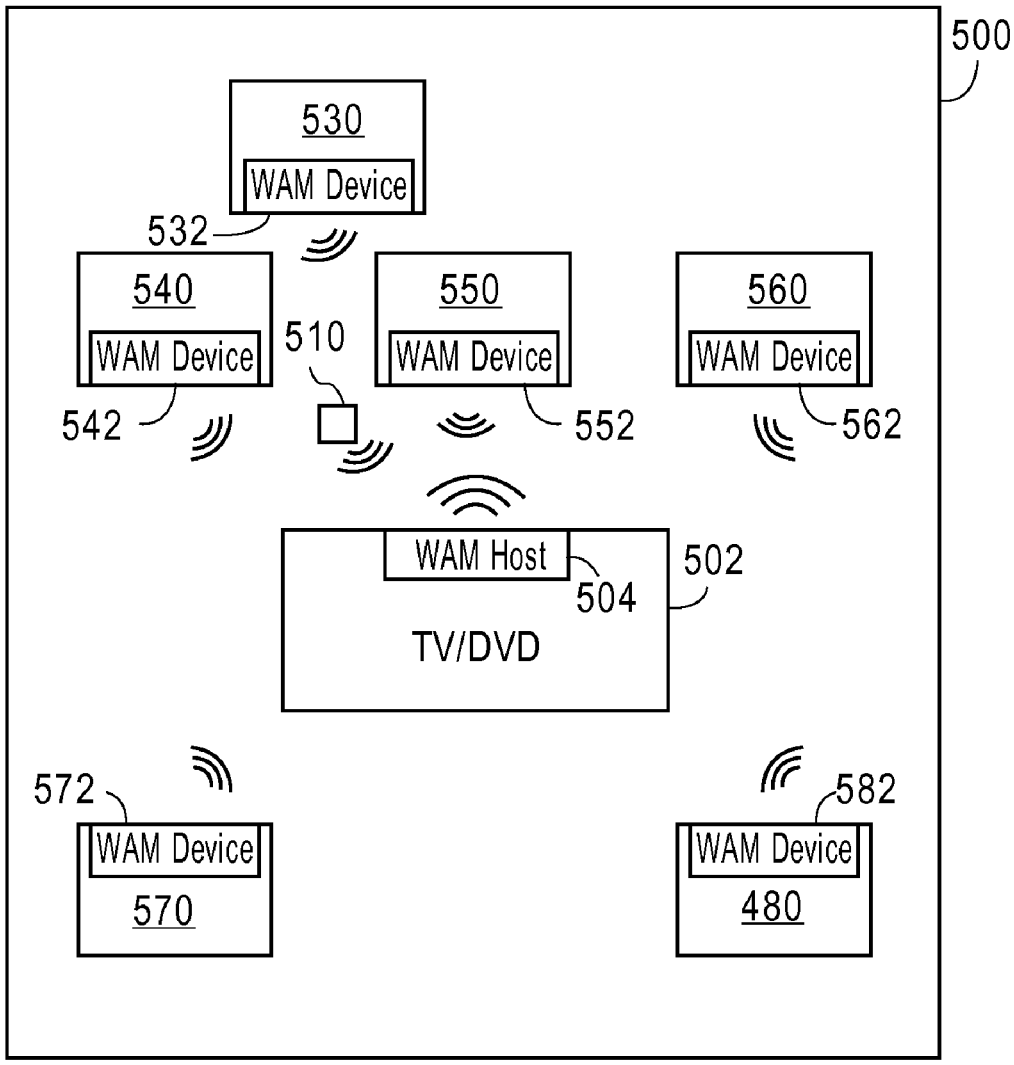
FIG. 5 is a block diagram of an AV system having a integrated DVD player and display with a WAM host in communication with wireless speakers and a wireless input/output device in accordance with an embodiment of the invention.

The wireless audio topology of FIG. 2 reduces clutter and also enables consolidation of devices and multiple locations of the WAM host, as shown in FIGS. 2-5. In each of FIGS. 3-5, the AV receiver separate component has been combined with an HDMI DVD player 302 (FIG. 3) or an HDMI TV 402 (FIG. 4) or an integrated HDMI DVD player/TV 502 (FIG. 5). This consolidation is possible with the wireless audio topology because a major portion of the AV receiver—namely, the centralized amplifier for the speakers—has been effectively distributed to each of the speakers. With this often large and heat-producing section removed from the core components, replaced with a single WAM host, it is possible to economically create multi-channel audio output capabilities from a source. Such a WAM host can reside inside a DVD player or TV chassis. Even better, neither the DVD player nor the TV need to add any extra connectors to provide such support, as the capability is made available via a wireless system, when the associated antennas are located internal to the box that contains the WAM host.

Note that the topology between WAM host and WAM devices is point-to-multi-point, implemented via a Ultra Wideband (UWB) Host/Device architecture. Also noteworthy is the ability for bidirectional communications over the wireless link, as depicted with the wireless beacon-like icons. The majority of the data transferred in such an audio application is from host to devices, but very important, infrequent data is sent from the devices to the host, communicating acknowledgements of data transfers and application-specific information, such as packet reception reliability statistics. Such bidirectional communication is also useful to enable detection of devices, which allows for many ease-of-use capabilities, such as auto-configuration of the audio system optimized to the speakers available for output. Additionally, the absence of speaker wires enables a simpler-to-setup, less cluttered environment, and allows the pristine digital audio content to reach the speakers with no signal loss.

FIG. 3 is a block diagram of an AV system having a DVD player with a WAM host in communication with wireless speakers and a wireless input/output device in accordance with an embodiment of the invention. The system 300 includes the HDMI DVD player 302 with the WAM host 304. The HDMI DVD player 302 is coupled to a HDMI TV 320. For one embodiment, the system 300 further includes a plurality of wireless speakers 330, 340, 350, 360, 370, and 380 each having a respective WAM device 332, 342, 352, 362, 372, and 382 to enable communication with the WAM host 304. The WAM devices and WAM host communicate control and data information bidirectionally for various purposes including configuring and calibrating audio parameters of the wireless speakers.

The system 300 further includes a wireless input/output device 310 to enable bidirectional communications with the WAM host 304 in order to automatically configure the plurality of wireless speakers 330, 340, 350, 360, 370, and 380 and to optimize audio parameters of the wireless speakers 330, 340, 350, 360, 370, and 380.

For an embodiment, the DVD player 302 is a home theatre in a box (HTiB) with a wireless audio module (WAM) host 304. The plurality of wireless speakers each having a wireless transceiver (e.g., WAM device 332, 342, 352, 362, 372, or 382) to enable bidirectional communications with the WAM host 304.

The automatic configuration of the wireless speakers includes determining a location for each speaker in order to identify each speaker. The automatic configuration further includes setting time delay parameters for each speaker. For example, a speaker closer in distance to the WAM host 304 may require a different delay compared to a speaker further from the WAM host 304 in order to optimize audio parameters from the speakers as a group. The automatic configuration further includes setting volume parameters for each speaker.

For some embodiments, the system 300 will adjust various audio parameters to optimize playback based on room acoustics for a given location of the system 300. Communication between the wireless input/output device 310 and the DVD player 302 is handled wirelessly to simplify the operation for the end user or consumer. The wireless input/output device 310 can be easily located in an ideal listening position for configuration of the wireless speakers. A consumer can easily configure audio equipment to optimize audio quality in order to match room acoustics.

FIG. 4 is a block diagram of an AV system having a display with a WAM host in communication with wireless speakers and a wireless input/output device in accordance with an embodiment of the invention. The system 400 includes the display or HDMI display 402 with the WAM host 404. The HDMI display 402 is coupled to a HDMI DVD player 490. For one embodiment, the system 400 further includes a plurality of wireless speakers 430, 440, 450, 460, 470, and 480 each having a respective WAM device 432, 442, 452, 462, 472, and 482 to enable communication with the WAM host 404. The WAM devices and WAM host communicate control and data information bidirectionally for various purposes including configuring and calibrating audio parameters of the wireless speakers.

The system 400 further includes a wireless input/output device 410 to enable bidirectional communications with the WAM host 404 in order to automatically configure the plurality of wireless speakers 430, 440, 450, 460, 470, and 480 and to optimize audio parameters of the wireless speakers 430, 440, 450, 460, 470, and 480.

For some embodiments, the system 400 will adjust various audio parameters to optimize playback based on room acoustics for a given location of the system 400. Communication between the wireless input/output device 410 and the display 402 is handled wirelessly to simplify the operation for the end user or consumer. The wireless input/output device 410 can be easily located in an ideal listening position for configuration of the wireless speakers. A consumer can easily configure audio equipment to optimize audio quality in order to match room acoustics.

FIG. 5 is a block diagram of an AV system having an integrated DVD player and display with a WAM host in communication with wireless speakers and a wireless input/output device in accordance with an embodiment of the invention. The system 500 includes the integrated DVD player and display or a HDMI integrated DVD player and display 502 with the WAM host 504. For one embodiment, the system 500 further includes a plurality of wireless speakers 530, 540, 550, 560, 570, and 580 each having a respective WAM device 532, 542, 552, 562, 572, and 582 to enable communication with the WAM host 504. The WAM devices and WAM host communicate control and data information bidirectionally for various purposes including configuring and calibrating audio parameters of the wireless speakers.

The system 500 further includes a wireless input/output device 510 to enable bidirectional communications with the WAM host 504 in order to automatically configure the plurality of wireless speakers 530, 540, 550, 560, 570, and 580 and to optimize audio parameters of the wireless speakers 530, 540, 550, 560, 570, and 580.

For some embodiments, the system 500 will adjust various audio parameters to optimize audio performance based on room acoustics. Communication between the wireless input/output device 510 and the integrated DVD player and display 502 is handled wirelessly to simplify the operation for the end user or consumer. The wireless input/output device 510 can be easily located in any desired position for configuration of the wireless speakers. A consumer can easily configure the system 500 to optimize audio quality in order to match room acoustics.

Figure 6:
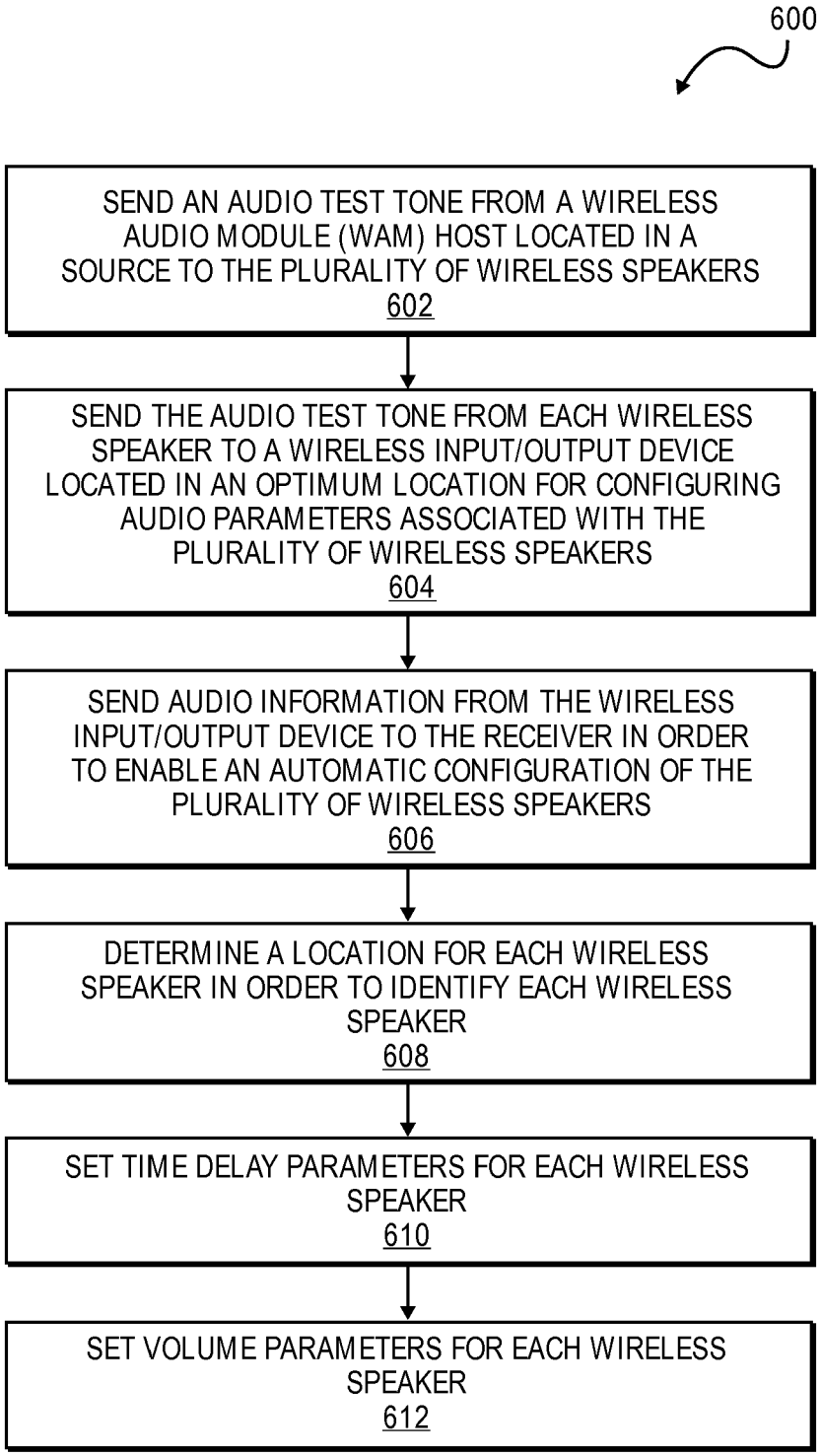
FIG. 6 is a flowchart of a method for configuring wireless speakers with a wireless input/output device in accordance with an embodiment of the present invention.

FIG. 6 is a flowchart of a method for configuring wireless speakers with a wireless input/output device in accordance with an embodiment of the present invention. The method 600 includes sending an audio test tone from a WAM host located in a source (e.g., an AV receiver, a DVD player, a display, an integrated DVD player/display, a HDMI AV receiver, a HDMI DVD player, a HDMI display, or a HDMI integrated DVD player/display) to the plurality of wireless speakers at block 602. The method 600 further includes sending the audio test tone from each wireless speaker to a wireless input/output device located in an optimum location for configuring audio parameters associated with the plurality of wireless speakers at block 604. The method 600 further includes sending audio information from the wireless input/output device to the source in order to enable an automatic configuration of the plurality of wireless speakers at block 606.

The method 600 further includes determining a location for each wireless speaker in order to identify each wireless speaker at block 608. The method 600 further includes setting time delay parameters for each wireless speaker at block 610. The method 600 further includes setting volume parameters for each wireless speaker at block 612.

The wireless input/output device can be a separate wireless microphone or embedded in a remote controller of the source. For example, in addition to enabling auto-configuration of the wireless speakers, the wireless input/output device can also be used as a microphone for karaoke or other types of entertainment.

The wireless input/output device is not coupled to the source in contrast to a prior approach for configuring speakers, wired or wireless. A consumer can easily configure the wireless speakers by locating the wireless input/output device in an ideal listening and configuration position. Also, in contrast to the prior art having one-directional communication, bidirectional communications between the source and wireless input/output device can optimize the configuration and calibration procedures.

Figure 7:
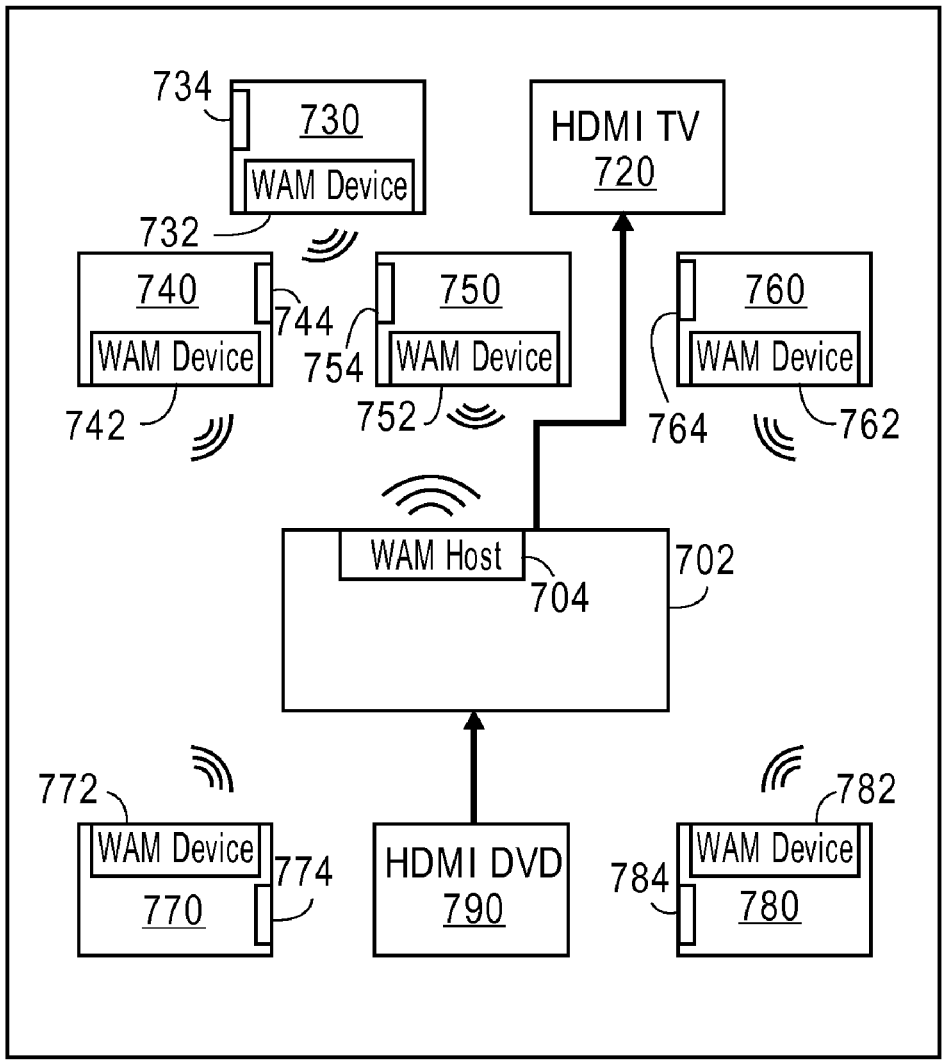
FIG. 7 is a block diagram of an AV system having a source with a WAM host in communication with wireless speakers having embedded input/output devices in accordance with an embodiment of the invention.

FIG. 7 is a block diagram of an AV system having a source with a WAM host in communication with wireless speakers having embedded input/output devices in accordance with an embodiment of the invention. The system 700 includes the source 702 (e.g., an AV receiver, a DVD player, a display, an integrated DVD player/display, a HDMI AV receiver, a HDMI DVD player, a HDMI display, or a HDMI integrated DVD player/display) with the WAM host 704. The source 702 may optionally be coupled to a HDMI TV 720 and HDMI DVD player 790 as illustrated in FIG. 7. Alternatively, one or more of these components may be included in the source 702. For one embodiment, the system 700 further includes a plurality of wireless speakers 730, 740, 750, 760, 770, and 780 each having a respective WAM device 732, 742, 752, 762, 772, and 782 to enable communication with the WAM host 704. The WAM devices and WAM host communicate control and data information bidirectionally for various purposes including configuring and calibrating audio parameters of the wireless speakers.

Each speaker further includes an embedded wireless input/output device (e.g., 734, 744, 754, 764, 774, and 784) to enable bidirectional communications with the WAM host 704 in order to adjust audio parameters of the plurality of wireless speakers 730, 740, 750, 760, 770, and 780 and to optimize these audio parameters of the wireless speakers 730, 740, 750, 760, 770, and 780. The embedded wireless input/output device may be an additional separate component as illustrated in FIG. 7 or it may be an existing component of a speaker such as a speaker cone used to perform the functionality of the input/output device (e.g., a microphone). For example, a speaker can be configured to perform the functionality of a microphone.

The automatic configuration of the wireless speakers includes determining a location for each speaker in order to identify each speaker. For example, an algorithm with a certain number of reference points may be used to determine a location for each speaker. The automatic configuration further includes setting time delay parameters for each speaker. The automatic configuration further includes setting volume parameters for each speaker. For example, a speaker closer in distance to the WAM host 704 may require a different volume parameter compared to a speaker further from the WAM host 704 in order to optimize audio parameters from the speakers as a group.

The wireless input/output devices 734, 744, 754, 764, 774, and 784 located in the respective wireless speakers 730, 740, 750, 760, 770, and 780 are not physically coupled to the source in contrast to a prior wired approach for configuring speakers, wired or wireless. The system 700 performs an auto-configuration of the wireless speakers without a wired microphone or remote controller, and without a dependence upon location of the microphone. Also, in contrast to the prior art having a one directional communication, bidirectional communications between the source and wireless input/output devices can optimize the configuration and calibration procedures.

Figure 8:
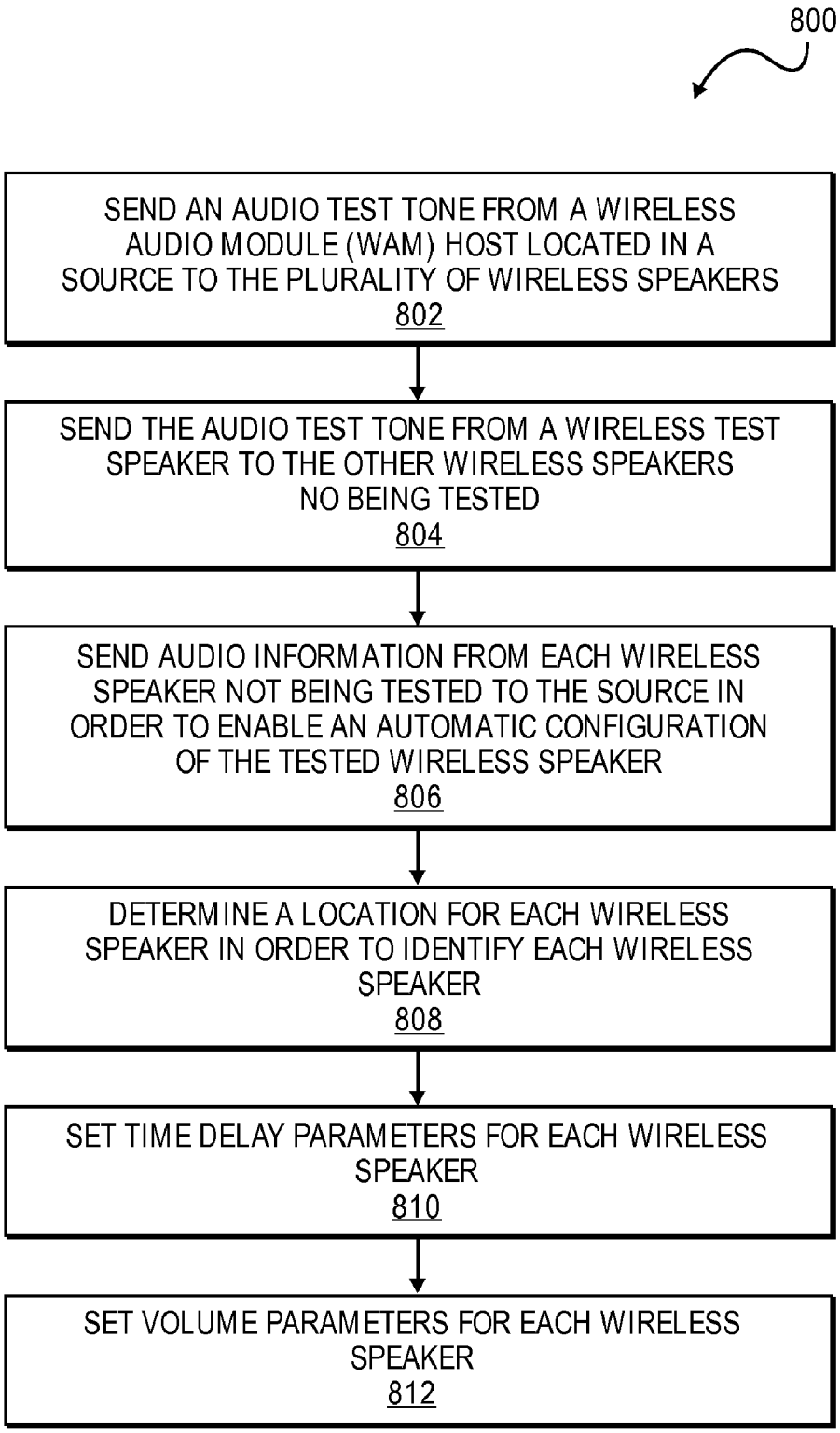
FIG. 8 is a flowchart of a method for configuring wireless speakers having embedded input/output devices in accordance with an embodiment of the present invention.

FIG. 8 is a flowchart of a method for configuring wireless speakers having embedded input/output devices in accordance with an embodiment of the present invention. The method 800 includes sending an audio test tone from a WAM host located in a source (e.g., an AV receiver, a DVD player, a display, or an integrated DVD player/display, a HDMI AV receiver, a HDMI DVD player, a HDMI display, or a HDMI integrated DVD player/display) to the plurality of wireless speakers at block 802. The method 800 further includes sending the audio test tone from a wireless test speaker to the other wireless speakers not currently being tested at block 804. The method 800 further includes sending audio information from each wireless speaker not being tested to the source in order to enable an automatic configuration of the tested speaker at block 806. The operations of blocks 802, 804, and 806 may be repeated in order to test each wireless speaker individually. The method 800 further includes determining a location for each wireless speaker in order to identify each wireless speaker at block 808. The method 800 further includes setting time delay parameters for each wireless speaker at block 810. The time delay parameters may include a time reference or base and time stamps to indicate when a speaker received a test tone. The method 800 further includes setting volume parameters for each wireless speaker at block 812.

Figure 9A:
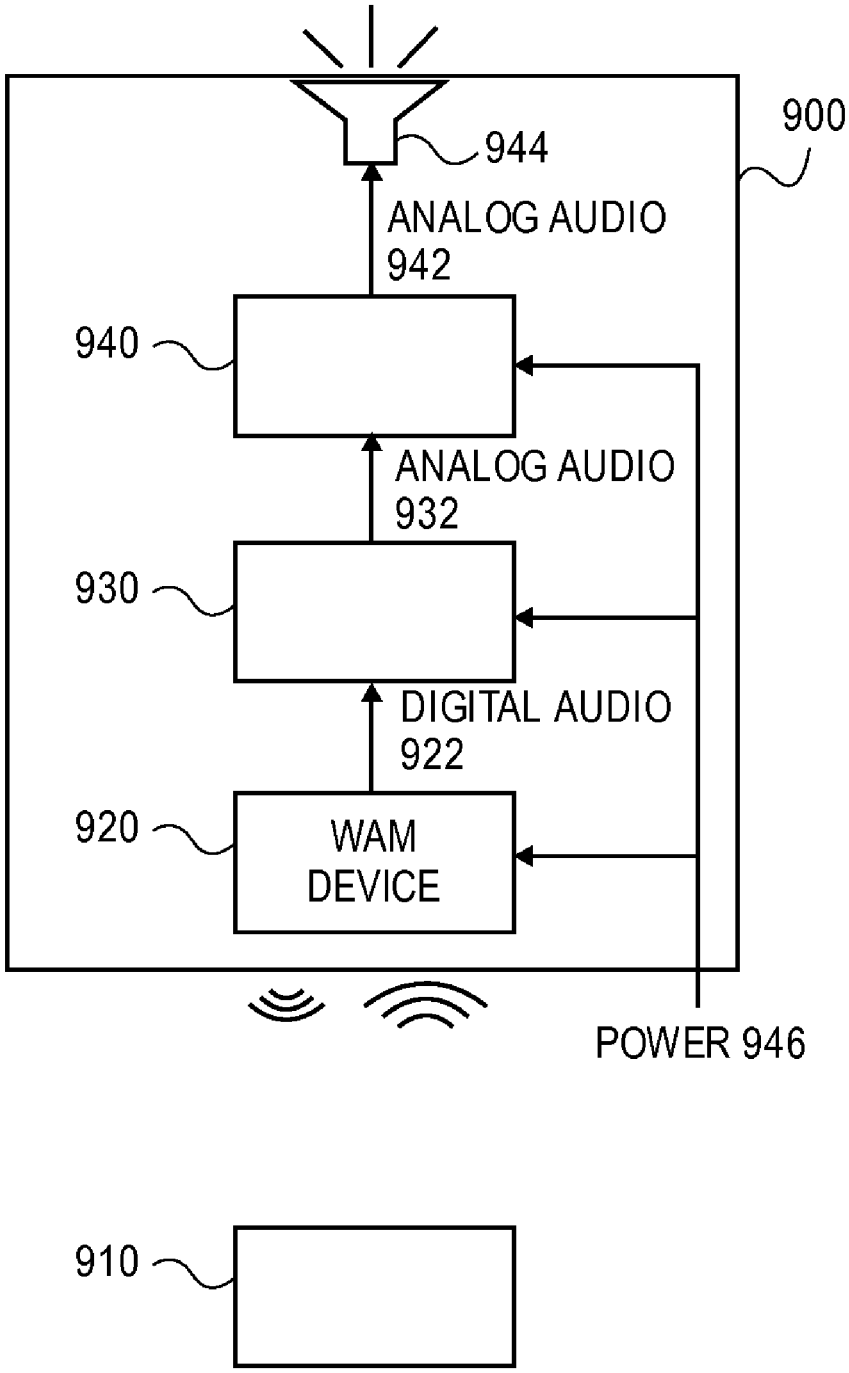
FIG. 9A is a block diagram of a wireless speaker with a WAM Device in accordance with an embodiment of the invention.

FIG. 9A is a block diagram of a wireless speaker subsystem with a WAM device communicating with a WAM host in accordance with an embodiment of the invention. To expand upon the automatic configuration of wireless speakers, it is helpful to understand the internals of the wireless speaker subsystem 900, an example of which is shown in FIG. 9A. The wireless speaker subsystem 900 includes the WAM device 920, which receives wireless audio data, auxiliary packets, and/or audio test tones from the WAM host 910 as well as sends back audio information to the host 910, as required, and further illustrated in FIG. 9B. The WAM device 920 may also send audio information to other wireless speakers and/or a wireless input/output device as discussed above.

The wireless speaker subsystem 900 further includes an audio Digital-to-Analog Converter (DAC) 930, which takes in the digital audio data from the WAM device 920, and converts it to analog. This analog line-level signal is then sent to the audio amplifier 940, which can be specifically designed to match the loudspeaker driver 944, as it is resident in the same enclosure as the driver 944 in this topology. Power 946 is specifically noted in this block diagram showing that there is a need for power in the wireless speakers to allow the active electronics to be powered, as well as allocating sufficient power for the audio amplifier performance desired for the subsystem 900.

Figure 9B:
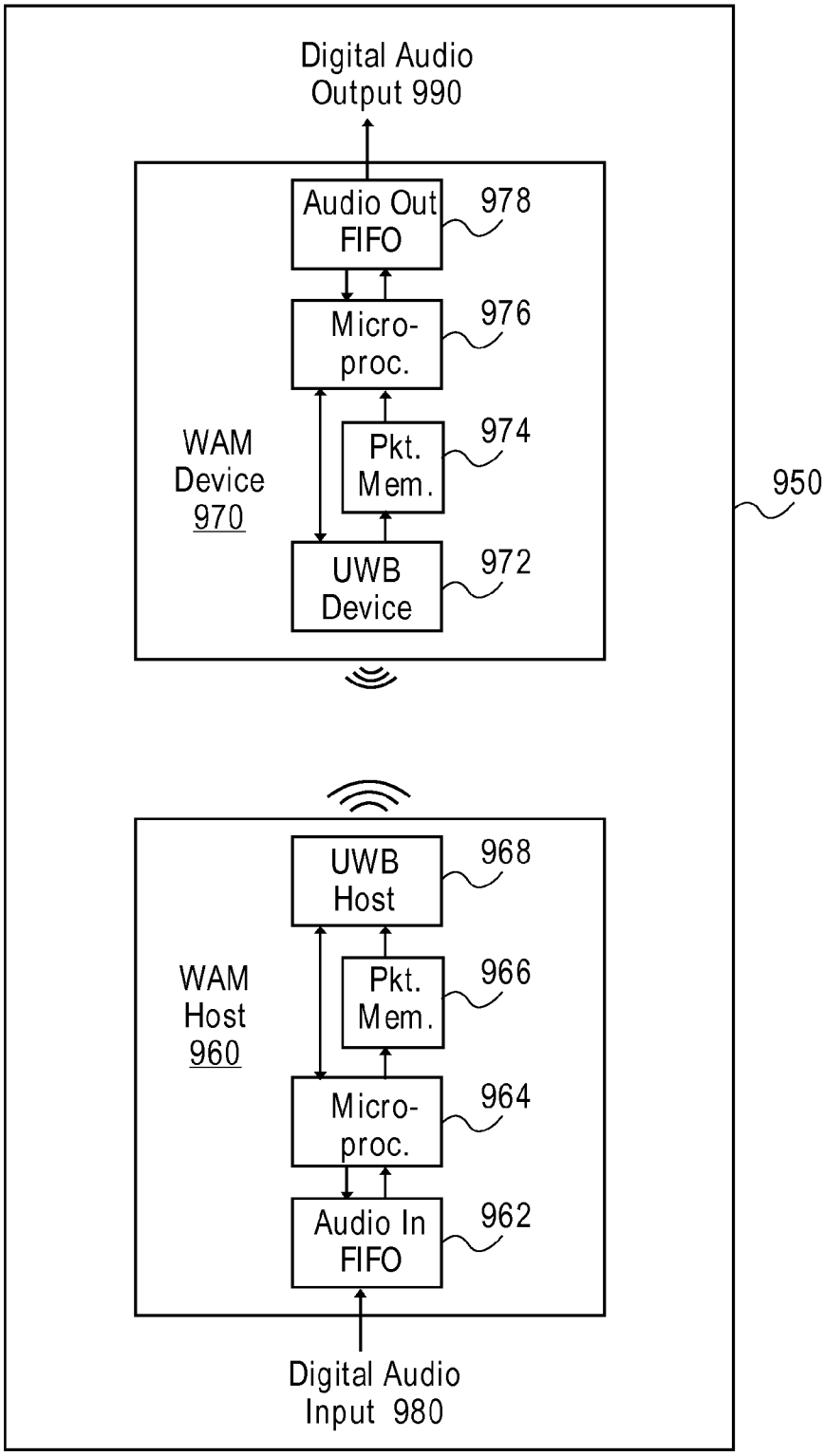
FIG. 9B is a block diagram of a system with a WAM Host communicating with a WAM Device in accordance with an embodiment of the invention.

FIG. 9B is a block diagram of a system with a WAM host communicating with a WAM device in accordance with an embodiment of the invention. The WAM host 960 includes an audio-in first-in first-out buffer ("FIFO") 962, a microprocessor 964, memory 966 allocated for packet storage, and a certified wireless USB ("CWUSB") host device 968. The WAM device 970 includes an audio-out FIFO 978, a microprocessor 976, memory 974 allocated for packet storage, and a UWB device 972. The system 950 receives digital audio input 980 from a source, sends it wirelessly over UWB, and produces digital audio output 990 from each device 970. The microprocessor included in each WAM embodiment must perform sophisticated management and execute complex algorithms tailored to the wireless medium and the dynamic system requirements. Although not shown in FIG. 9B, the WAM host must process and transmit all digital audio channels, while a WAM device might only consume a single audio channel. The WAM host's management of communications, data routing, and synchronization for all the audio channels supported in a system is a significant task.

FIGS. 2-5 and 7 illustrate various AV systems with 5.1 surround sound based on having a plurality of wireless speakers including a front left speaker, a front right speaker, a center speaker, a surround left speaker, a surround right speaker, and a first low frequency effect (LFE) speaker. For one embodiment, the various AV systems may further include a side left surround speaker and a side right surround speaker to provide 7.1 surround sound. For another embodiment, the various AV systems may further include a second LFE speaker. The various AV systems can provide up to 127 separate wireless audio channels enabling various surround sound arrangements such as 10.2 theatre surround, 22.2 surround, or 22.3 surround.

High quality pristine digital audio based on optimized wireless speaker configuration can be provided for various arrangements with no wired microphone required. For example, a consumer can quickly and easily configure the wireless speakers without having to properly position a wired microphone. For one embodiment, a speaker configuration can be performed without having a separate microphone component.

In the foregoing specification, the invention has been described with reference to specific exemplary embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. An apparatus, comprising:

an audio receiver with a wireless audio module (WAM) host, the WAM host including a High-Definition Multimedia interface ("HDMI") over which to communicate HDMI data representing audio signals wirelessly;

a plurality of wireless speakers each having a WAM device to enable bidirectional communications with the WAM host to receive the HDMI data representing the audio signals wirelessly; and a wireless input/output device configured to receive the audio signals at a configuration position from each wireless speaker in at least a subset of the plurality of wireless speakers and to transmit audio information wirelessly to the WAM host to automatically configure the subset of the plurality of wireless speakers to optimize audio parameters of the wireless speakers, the WAM host being configured to use the audio information from the wireless input/output device to optimize the audio parameters relative to the configuration position from which the wireless input/output device transmits to the WAM host, wherein a wireless speaker of the plurality of wireless speakers is automatically configured to optimize an audio parameter as a function of a distance of the wireless speaker.

2. The apparatus of claim 1, wherein the automatic configuration comprises determining a location for each speaker in order to identify each speaker relative to the configuration position at which wireless input/output device is disposed, the configuration position located within an area enclosed by the subset of the plurality of wireless speakers.

3. The apparatus of claim 1, wherein the automatic configuration comprises setting time delay parameters for each speaker.

4. The apparatus of claim 1, wherein the automatic configuration comprises setting volume parameters for each speaker.

5. The apparatus of claim 1, wherein the wireless input/output device comprises a wireless microphone.

6. The apparatus of claim 1, wherein the wireless input/output device is embedded in a remote control device to operate the receiver, wherein the receiver is located in one of a TV, a DVD player, and an integrated TV/DVD player, a high definition multimedia interface (HDMI) TV, a HDMI DVD player, and an integrated HDMI TV/DVD player.

7. The apparatus of claim 1, wherein the plurality of wireless speakers comprise a front left speaker, a front right speaker, a center speaker, a surround left speaker, a surround right speaker, and a subwoofer speaker.

8. The apparatus of claim 1, further comprising:

a first ultra-wideband ("UWB") device disposed in the WAM host; and a second ultra-wideband ("UWB") device disposed in each of the WAM devices, wherein the first and the second UWB devices are configured to communicate the HDMI data wirelessly.

9. A system, comprising:

source of either audio signals or video signals, or both, including a wireless audio module (WAM) host, the WAM host including a High-Definition Multimedia Interface ("HDMI") configured to communicate uncompressed audio wirelessly;

a plurality of wireless speakers each having a wireless transceiver to enable bi-directional communications with the WAM host, each of the plurality of wireless speakers being configured to receive the uncompressed audio wirelessly and to generate audio based on the uncompressed audio; and a wireless input/output device at a configuration position, the wireless input/output device configured to receive the audio from each of the plurality of wireless speakers and to communicate audio information wirelessly to the WAM host to automatically configure the plurality of wireless speakers to optimize audio parameters of the wireless speakers based on locations of each of the plurality of wireless speakers relative to the configuration position, wherein at least one wireless speaker of the plurality of wireless speakers is automatically configured to optimize an audio parameter as a function of a location of the wireless speaker.

10. The system of claim 9, wherein the automatic configuration comprises determining a location for each speaker in order to identify each speaker.

11. The system of claim 9, wherein the automatic configuration comprises setting time delay parameters and volume parameters for each speaker.

12. The system of claim 9, wherein the source comprises one of an AV receiver, a DVD player, a HDMI display, a HDMI integrated DVD player/display, a high definition multimedia interface (HDMI) AV receiver, a HDMI DVD player, a HDMI display, and a HDMI integrated DVD player/display.

13. A method comprising:

transmitting wirelessly data representing uncompressed audio from a wireless audio module (WAM) host as a High-Definition Multimedia Interface ("HDMI") audio data, the HDMI audio data being communicated in an ultra wideband ("UWB") host-to-speaker architecture;

receiving at one or more wireless speakers the HDMI audio data, each of the one or more wireless speakers having a wireless transceiver to enable bi-directional communications with the WAM host;

transmitting from each of the plurality of wireless speakers audio based on the HDMI audio data to a wireless input/output device at a configuration position;

receiving the audio at the wireless input/output device;

enabling bi-directional communications between the wireless input/output device and the WAM host to communicate audio information wirelessly; and configuring automatically the plurality of wireless speakers to optimize audio parameters of the wireless speakers based on locations of each of the plurality of wireless speakers relative to the configuration position, wherein at least one wireless speaker of the plurality of wireless speakers is being automatically configured to optimize an audio parameter based on a distance from the wireless speaker to the configuration position.

14. The method of claim 13, further comprising:

determining a location for each speaker in order to identify each speaker.

15. The method of claim 13, further comprising:

setting time delay parameters and volume parameters for each speaker.

16. The method of claim 13, wherein receiving the audio further comprises:

receiving the audio into a microphone in the wireless input/output device.

17. The method of claim 13, further comprising:

identifying a front left speaker, a front right speaker, a center speaker, a surround left speaker, a surround right speaker, and a subwoofer speaker.

* * * * *